US007154509B2

(12) United States Patent
Nair et al.

(10) Patent No.: US 7,154,509 B2
(45) Date of Patent: Dec. 26, 2006

(54) APPARATUS AND METHOD FOR MULTI-RESOLUTION COLOR MAPPING FOR DISPLAY DEVICES

(75) Inventors: Hari Nair, Bangalore (IN); Neha Agrawal, Bangalore (IN); Saif Choudhary, Bangalore (IN); Shashi Kumar, Bangalore (IN); Arun Johary, San Jose, CA (US)

(73) Assignee: Genesis Microchip Inc., Alviso, CA (US)

( * ) Notice: Subject to any disclaimer, the term of this patent is extended or adjusted under 35 U.S.C. 154(b) by 78 days.

(21) Appl. No.: 10/890,077

(22) Filed: Jul. 12, 2004

(65) Prior Publication Data

US 2004/0246268 A1 Dec. 9, 2004

Related U.S. Application Data

(63) Continuation of application No. 10/146,257, filed on May 13, 2002, now Pat. No. 6,833,839.

(51) Int. Cl.
*G09G 5/02* (2006.01)

(52) U.S. Cl. ..... 345/601; 345/602; 345/604; 345/698

(58) Field of Classification Search ..... 341/106; 345/3.3, 600, 601, 602, 604, 698, 122 FOR; 347/184; 348/333.11; 358/3.23; 382/148, 382/299; 702/162 FOR; 704/256.8; 708/235; 714/759

See application file for complete search history.

(56) References Cited

U.S. PATENT DOCUMENTS 4,914,437 A 4/1990 Kibrick et al.
5,325,522 A 6/1994 Vaughn
5,796,385 A * 8/1998 Rich ..... 345/600
6,026,179 A 2/2000 Brett
6,268,939 B1 7/2001 Klassen et al.
6,320,676 B1 11/2001 Yoshidome
6,340,994 B1 1/2002 Margulis et al.
6,351,320 B1 2/2002 Shin
6,464,640 B1 10/2002 Guracar et al.
6,541,921 B1 4/2003 Luciano et al.
2001/0033260 A1 10/2001 Nishitani et al.

* cited by examiner

*Primary Examiner*—Kee M. Tung
*Assistant Examiner*—G. F. Cunningham
(74) *Attorney, Agent, or Firm*—Beyer Weaver & Thomas, LLP

(57) ABSTRACT

An apparatus and method for allowing color adjustments in display devices is disclosed The apparatus comprises a multi-resolution structure for providing color adjustments; and an interpolator for interpolating at least one offset of the multi-resolution structure. An apparatus and method in accordance with the present invention uses a combination of color look-up tables with different levels of resolution, followed by interpolation to provide a display process which has high resolution but utilizes minimal memory. In so doing, memory is used for high-resolution areas only where needed. The multi-resolution structure is a very good approximation to the theoretical mapping table in the areas where it is needed. At the same time, since the high resolution areas are localized, a significant reduction in memory storage is possible.

12 Claims, 5 Drawing Sheets

10

100

APPARATUS AND METHOD FOR MULTI-RESOLUTION COLOR MAPPING FOR DISPLAY DEVICES

CROSS REFERENCE TO RELATED APPLICATIONS

This application is a continuation of U.S. application Ser. No. 10/146,257 filed May 13, 2002 now U.S. Pat. No. 6,833,839 entitled "Apparatus and method for multi-resolution color mapping for display devices" which is hereby incorporated by reference.

FIELD OF THE INVENTION

The present invention relates generally to digital display devices and particularly to an apparatus and method for multi-resolution color mapping for display devices.

BACKGROUND OF THE INVENTION

Video displays normally have color adjustment controls for hue and saturation. The hue control adjusts the tint and the saturation control adjusts the color richness of the display. These controls are global in the sense that they affect all the display pixels.

For applications such as skin tone adjustment, global color controls cannot be applied. These applications require local modification of a small subset of colors in the color space without affecting the other colors.

Local color modifications in display devices can be implemented by a mapping table that specifies an output color for every input color. This would be feasible if the set of all possible colors was reasonably small. However, a standard 24-bit RGB display device would need to map approximately 16 million different colors. The map, also known as a look-up table (LUT), would require 48 Mbytes of memory storage. Considering the cost of a 48 Mbyte lookup table implemented either in hardware or in software, this solution is not practical. Using a luma-chroma color space such as YUV, YPrPb etc. is a better solution because the colors are then represented by a subset of the components. The standard 8-bit resolution for U and V would require 128 Kbytes for the color map. This is still a very large memory for hardware implementations.

A more practical solution approximates the theoretical map by sampling the color space with a regular grid.

FIG. 1 is an example of a 4×4 sampling grid 10. The output values at the grid 10 intersections are stored in a table. A specific color will map to a unique coordinate within the grid. In general, the coordinate will not coincide with a grid vertex. An output value related to the coordinate is then calculated as an interpolation of the nearest output values, i.e. the values stored at the nearest grid vertices.

Sampling a space with a finer grid allows better control over the map because of the higher resolution, but at the cost of higher memory usage. A coarser grid saves memory at the expense of color resolution.

What is needed, therefore is a solution that approximates the theoretical mapping table as closely as possible without requiring an impractical amount of memory. Real-life applications such as skin tone adjustment concentrate on a small region of the full color space. Therefore high-resolution mapping is only required in a small subset of the color space. The present invention addresses such a need.

SUMMARY OF THE INVENTION

An apparatus and method for allowing color adjustments in display devices is disclosed. The apparatus comprises a multi-resolution structure for providing color adjustments; and an interpolator for interpolating at least one offset of the multi-resolution structure.

An apparatus and method in accordance with the present invention uses a combination of color look-up tables with different levels of resolution, followed by interpolation to provide a display process which has high resolution but utilizes minimal memory.

In so doing, memory is used for high-resolution areas only where needed. The multi-resolution structure is a very good approximation to the theoretical mapping table in the areas where it is needed. At the same time, since the high resolution areas are localized, a significant reduction in memory storage is possible.

DETAILED DESCRIPTION

The present invention relates generally to digital display devices and particularly to an apparatus and method for multi-resolution color mapping for display devices. The following description is presented to enable one of ordinary skill in the art to make and use the invention and is provided in the context of a patent application and its requirements. Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

Definitions

Digital Display Device: An electronic image display device that uses digitized (sampled and quantized) image data. The input data itself may be analog in nature, and digitized within the device for final display on a digital display such as an LCD, OLED or plasma panel. Alternatively, the input data itself may be digital in nature and finally displayed on an analog display such as a CRT.

Pixel: The smallest discrete region on a digital display device that can be addressed for display.

Luma: The component of the input image data value that is correlated to the perceived intensity of the displayed data value.

Chroma: The component of the input image data value that is correlated to the perceived color of the displayed data value. In YUV color space, the chroma component is defined by the U and V data values.

An apparatus and method in accordance with the present invention uses a combination of color look-up tables with different levels of resolution, followed by interpolation to provide a display process which has high resolution but utilizes minimal memory.

In so doing, memory is used for high-resolution areas only where needed. The multi-resolution structure is a very good approximation to the theoretical mapping table in the areas where it is needed. At the same time, since the high resolution areas are localized, a significant reduction in memory storage is possible.

An apparatus utilized in accordance with the present invention may be a hardware implementation, a combination of hardware and software, or a software implementation. An example of a hardware solution would be an FPGA or ASIC design. An example of a hardware and software implementation would include a DSP implementation and embedded firmware implementation.

Please refer to the following for a more detailed description of the features of the present invention.

Apparatus

Figure 1:
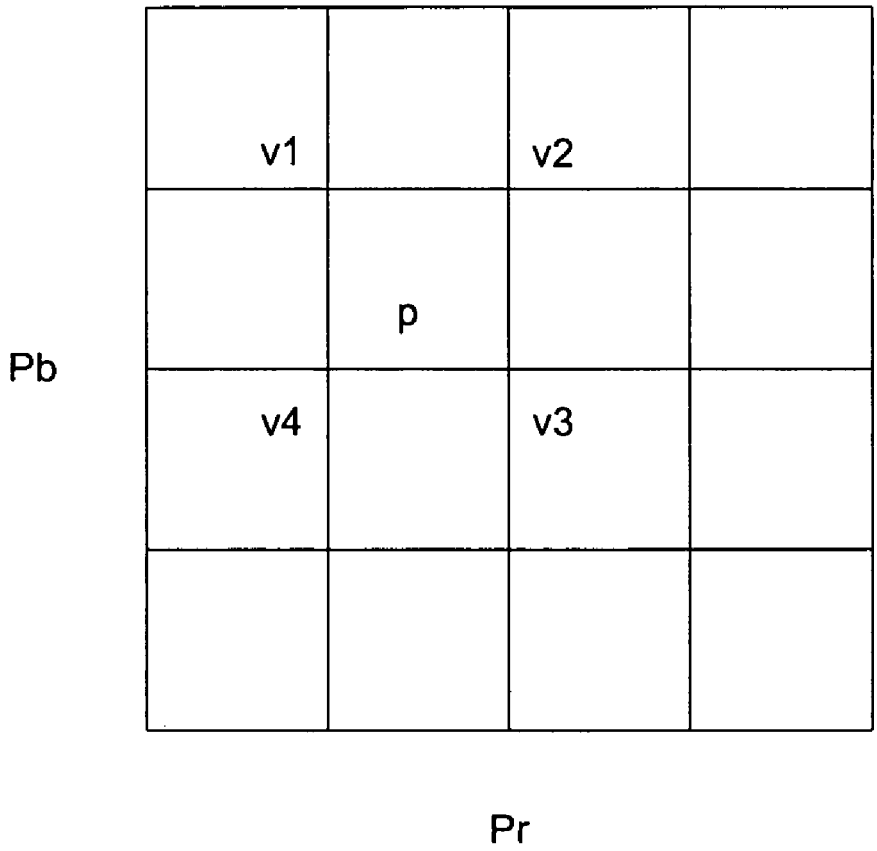
Prior Art Fig. 1
FIG. 1 is an example of a 4×4 sampling grid 10.
Figure 2:
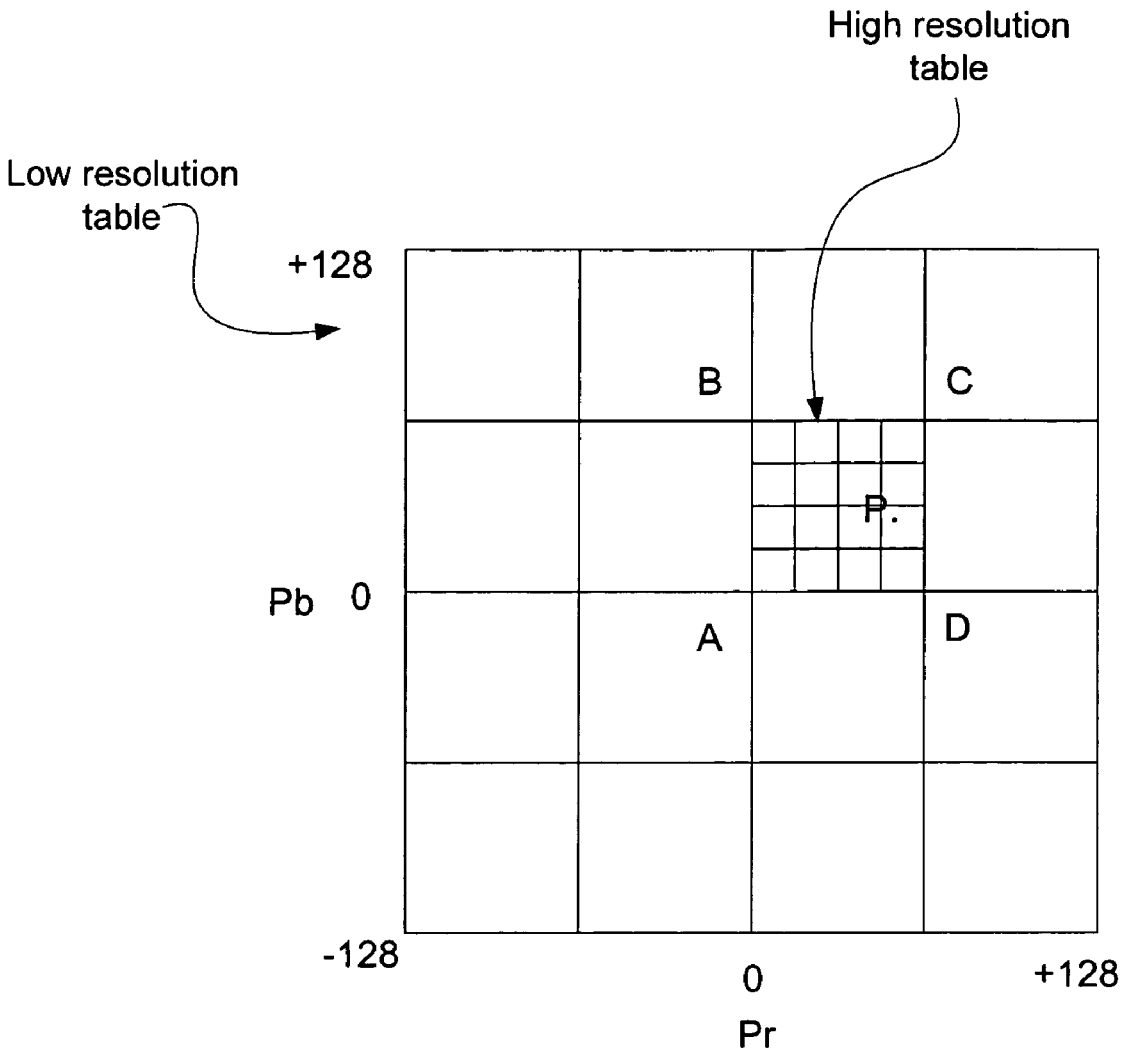
FIG. 2 illustrates a multi-resolution UV color structure in accordance with the present invention.
Figure 4:
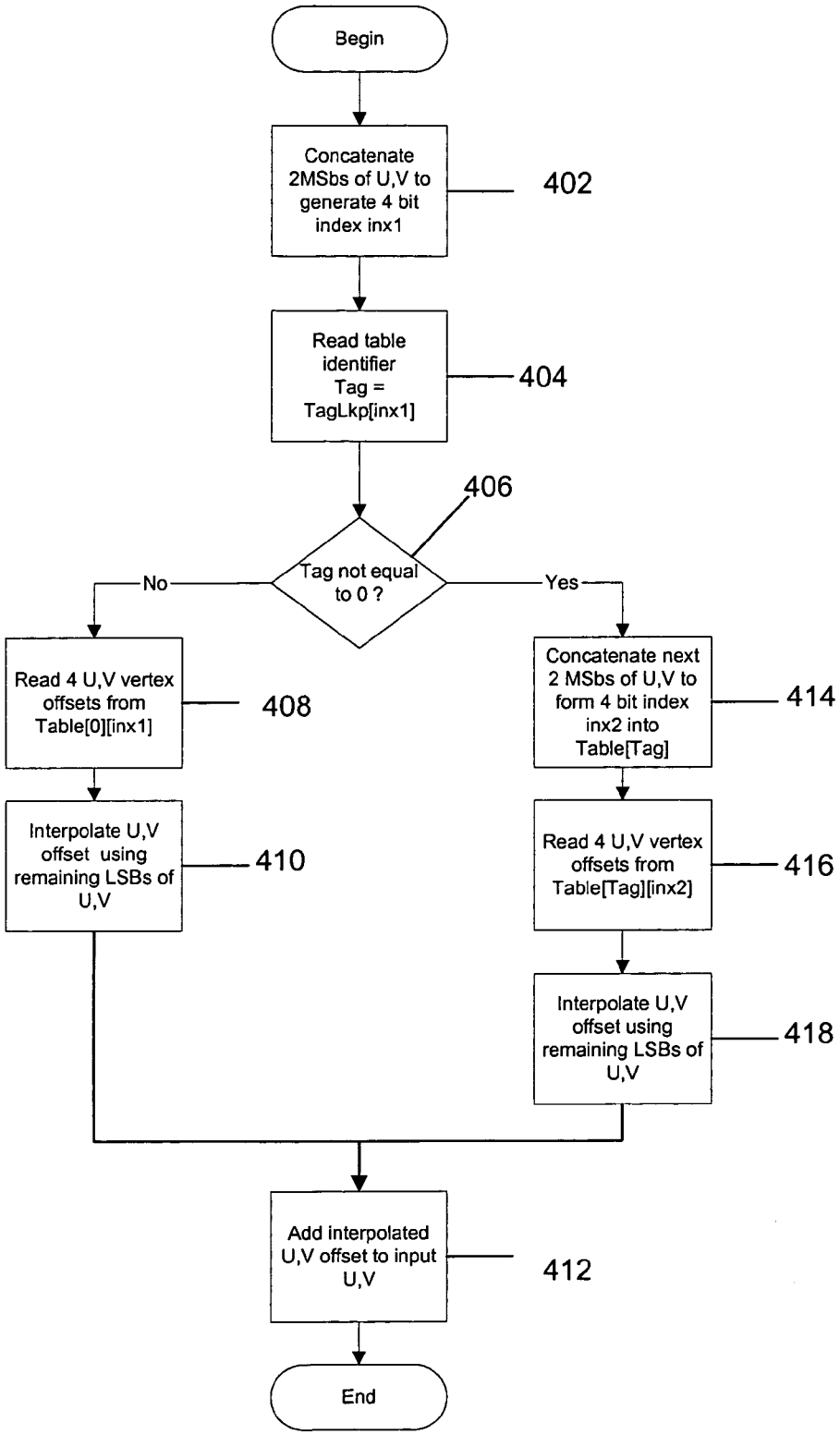
FIG. 4 is a flow chart which illustrates multi-resolution chroma mapping in an 8-bit UV space using two resolution levels.

FIG. 2 illustrates a multi-resolution UV color table 100 in accordance with the present invention. As is seen in this embodiment, a plurality of squares on the grid 200 are of one resolution, as illustrated by squares A, B, C and D, and at least one of the other squares is of another resolution as illustrated by FIG. 4. The apparatus for this invention is a set of data structures that can be implemented in hardware as memory and registers or in software as arrays. The primary data structure is used for storing the color LUT at different resolutions. The secondary data structures are used for indexing the final LUT to be applied.

The data input is a chroma value that is specified with two components—these may be defined as the UV components of a YUV representation for this description, but in general are any orthogonal representation of chroma. These components are digital values that are specified with a fixed precision, e.g. 8 bits or 10 bits.

For the description that follows, we assume the following:

8 bit UV color space

Two levels of resolution

One low-resolution table that divides the two-dimensional UV color space into 16 squares (4 sub-divisions on each axis).

Multiple high-resolution tables further divide each low-resolution square into 16 sub-squares.

Each LUT entry is a data word containing the U and V color offsets for all 4 square vertices.

Assuming that the U,V offset is represented with No bits, one vertex chroma offset requires 2No bits for storage. Storing all 4 vertex offsets for a square will require 4×2No=8No bits. One low-resolution table is required. If we specify Nh high-resolution tables, the multi-resolution table structure will then require a (Nh+1)×8No memory structure for a hardware implementation.

The savings in memory for the same effective resolution is readily seen—dividing the UV color space into a 16×16 grid requires 16×16×8No=2048No bits. A multi-resolution hybrid table with a 4×4 low-resolution table and four 4×4 high-resolution tables requires (4+1)×8No=40No bits.

Figure 3:
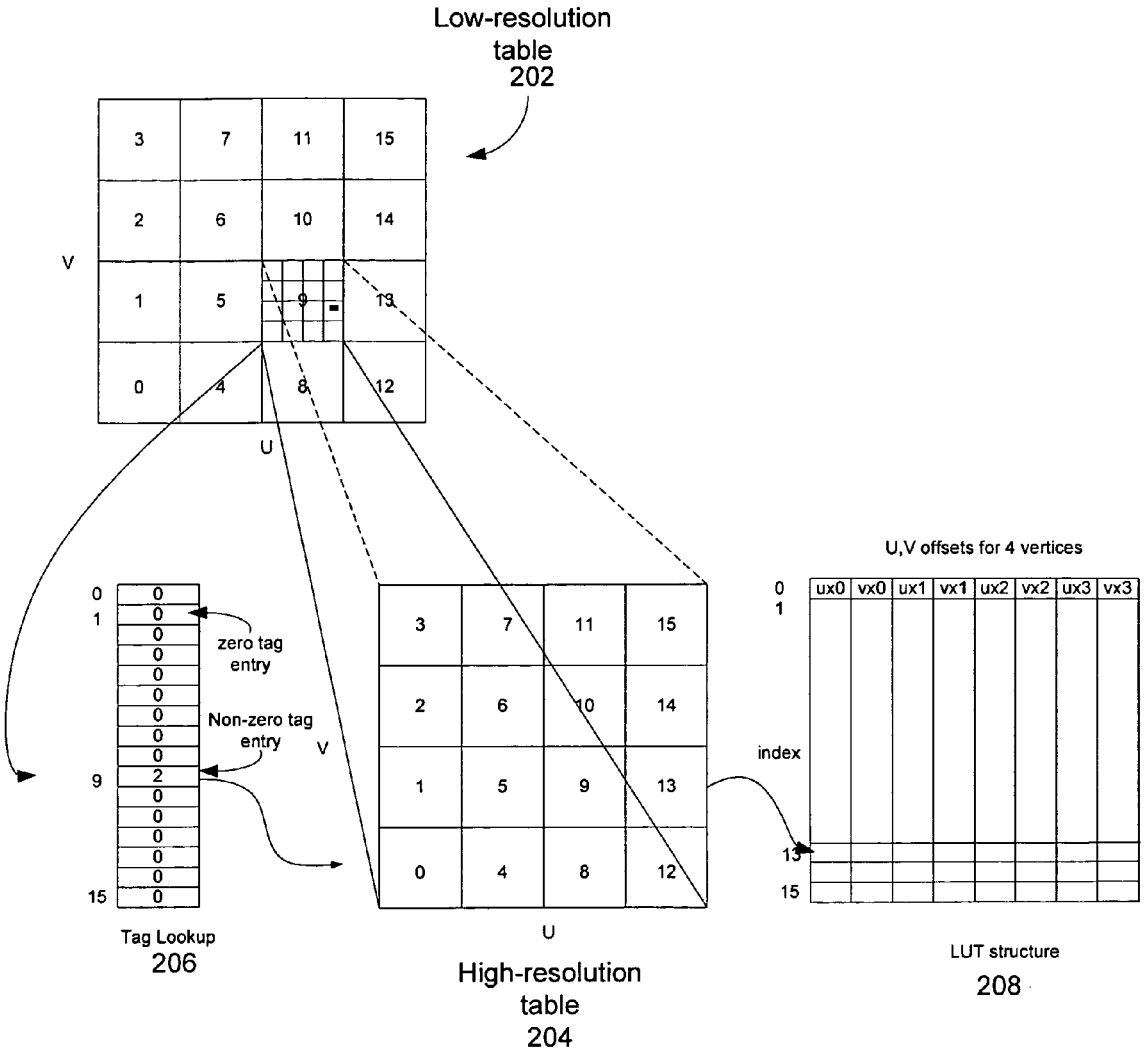
FIG. 3 illustrates a multi-resolution mapping system using a 2-levek, 8-bit UV color space.

FIG. 3 illustrates a multi-resolution mapping system 200 using a 2-level, 8-bit UV color space. As is seen, there is a low resolution table 202 and two high resolution tables 204. For a two-level resolution implementation, one secondary data structure 206, which is a one-dimensional tag table with 16 entries. The index to this table identifies a unique square in the low resolution table. A non-zero tag entry at this index specifies a unique high-resolution 204 table to be overlaid on this square in the low-resolution table. If it is zero, the low-resolution table 202 square is used for the color offset lookup and interpolation. If non-zero, the corresponding high-resolution table 204 is used for color offset lookup and interpolation. For the above example, an additional 16×3=48 bits of register storage would be required.

The low-resolution and high-resolution UV grids are conceptual representations only. The only data structures required are the chroma offset LUTs 208 and Tag Lookup table 206.

The location of an input pixel chroma value in UV space is shown as a black dot in square 9 in the low-resolution table. There are two high-resolution tables available with id 1 and 2 respectively. The high-resolution table with id 2 has been overlaid on square 9 of the low-resolution table, by specifying its id in the Tag Lookup table.

Method

FIG. 4 is a flow chart which illustrates multi-resolution chroma mapping in an 8-bit UV space using two resolution levels. The following description of the method applies to the above example with two-level resolution with a grid division of 4—however it can be easily extended to higher level resolution hierarchies and grid division factors.

Consider an input pixel that needs to be processed by the multi-resolution color map process. The chroma value is defined by the U and V components, which are 8 bit values.

Indexing: The 2 MSbs of U and V are concatenated to create a 4 bit index which uniquely identifies the high-resolution square in which this pixel chroma value lies (step 402).

Tag lookup: The index is used to read a tag from the Tag Lookup table. The tag value determines whether a high-resolution table has been overlaid on this particular coarse-resolution square, and if so, which table. If the tag is zero, the low-resolution table should be used. If the tag is non-zero, the value identifies which high-resolution table has been overlaid (step 404).

Low-resolution table interpolation: If the tag is zero, the remaining LSbs of U and V define the location of the input chroma value with respect to the four vertices of the surrounding low resolution square. The actual chroma offset to be applied is then determined by interpolation of the programmed chroma offsets stored at the four vertices using the U and V LSbs as the interpolation weights. The interpolated chroma offset is added to the input value to generate the output chroma value (steps 408 and 412).

High resolution table indexing: If the tag is non-zero, it uniquely identifies which fine-resolution table must be overlaid. The next 2 MSbs of U and V now are concatenated to form a 4 bit index which uniquely identifies the square in the high resolution table which encloses the input chroma value (steps 414 and 416).

Figure 5:
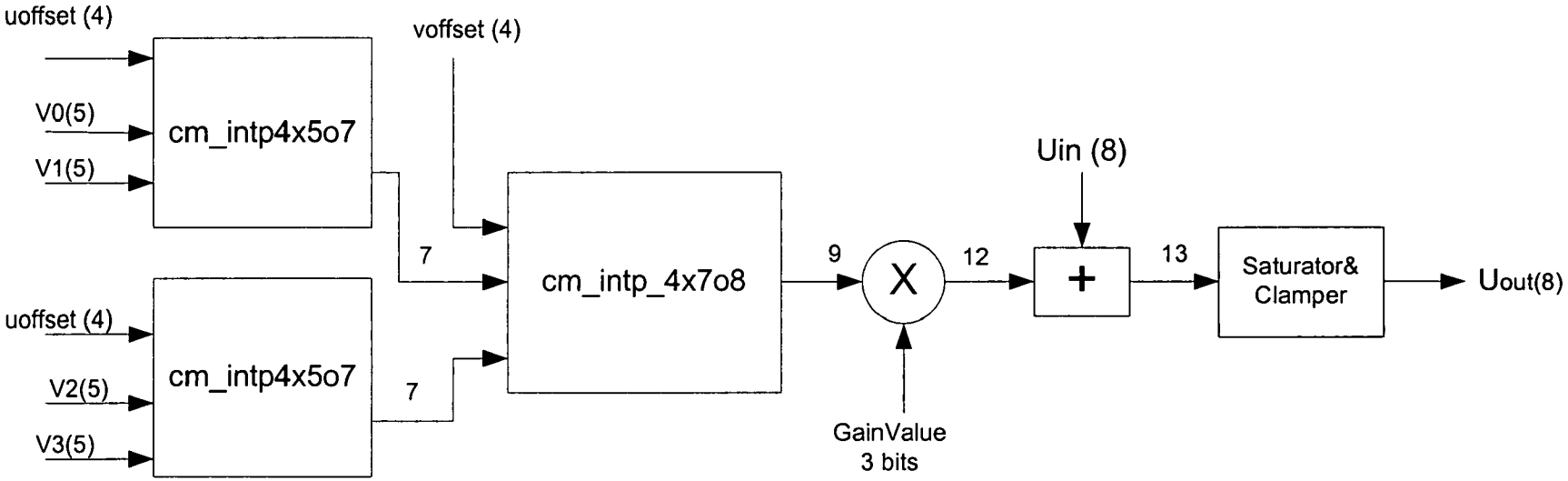
FIG. 5 is an example of a sample hardware implementation of bilinear interpolator for a two-dimensional look-up table.

High resolution table interpolation: Now the remaining 4LSbs of U and V define the location of the input chroma value with respect to the surrounding fine resolution square vertices. The actual chroma offset to be applied is then determined by interpolation of the programmed chroma offsets stored at the four vertices, using the U and V LSbs as interpolation weights. The interpolated chroma offset is added to the input value to generate the output chroma value (steps 418 and 412). FIG. 5 is an example of a sample hardware implementation of bilinear interpolator for the two-dimensional look-up table.

The above process can be easily extended to higher levels of resolution hierarchy. For a three-level structure, we will need two tag tables in addition to the color LUTs. The MSbs are used to progressively index into the tag tables until either the tag entry is zero, or the highest resolution level has been reached. Then the remaining LSbs are used to interpolate the chroma offset from the surrounding 4 vertices. This offset is then added back to the original to generate the output chroma value.

The final table indexing process is very efficient as it only requires concatenation of chroma data MSbs followed by table lookups.

For hardware implementations, the storage of all 4 vertex offsets in one memory word, combined with the storage of the tag entries in a separate data structure, allows single cycle access to memory for the interpolation, irrespective of the resolution level. This also allows the color LUTs at all resolution levels to be stored in a single physical memory.

For a specific application, such as skin tone adjustment, the high resolution tables are overlaid only in the low resolution squares that contain skin tone chroma values. This user-definable localization of high resolution areas in the map provides a very good approximation to the theoretical full resolution color map in the area of interest, while keeping the overall memory requirements manageable.

The purpose of storing offsets instead of an absolute chroma component is to reduce the amount of memory storage required. This is possible because the amount of offset applied is relatively small in comparison to the chroma dynamic range and can therefore be represented with less bits.

Although the present invention has been described in accordance with the embodiments shown, one of ordinary skill in the art will readily recognize that there could be variations to the embodiments and those variations would be within the spirit and scope of the present invention. Accordingly, many modifications may be made by one of ordinary skill in the art without departing from the spirit and scope of the appended claims.

What is claimed is:

1. A memory efficient, multi-resolution color mapping system for generating an output pixel color value by adjusting an input pixel color value, comprising:

a multi-resolution color look up table comprising:

a low resolution look up table formed of a number of low resolution color space regions each mapped by a set of low resolution color space region vertices;

a high resolution look up table formed of a number of high resolution color space regions each mapped by a set of high resolution color space region vertices;

a tag lookup table having at least one first tag entry having a first tag entry value that identifies a unique one of the low resolution color space regions and at least one second tag entry that corresponds to the at least one first tag entry having second tag entry value such that a non zero second tag entry value identifies a unique one of the high resolution color space regions, wherein when the second tag entry value is non zero, then the high resolution color space region uniquely identified by the non zero second tag entry value is overlaid on the low resolution color space region identified by the corresponding first tag entry value;

a color offset value look up table (LUT) of color offset values wherein the set of high resolution color space region vertices of the overlaying high resolution color space region are used to lookup a set of color offset values; and a means for generating the output pixel color value by adding the set of color offset values to the input pixel color value.

2. A system as recited in claim 1 wherein if the second tag entry value is zero, the low-resolution color space region identified by the corresponding first tag entry value is used for looking up the color offset value from the color offset value look up table.

3. A system as recited in claim 2, wherein the color value is a pixel chroma value.

4. A system as recited in claim 3, wherein the multi-resolution look up table is a multi-resolution chroma value look up table, wherein the low resolution look up table is a low resolution chroma value look up table and wherein the high resolution look up table is a high resolution chroma look up table.

5. A system as recited in claim 4, wherein the color offset value is a pixel chroma offset value.

6. A system as recited in claim 5, wherein the pixel chroma value is defined by a first and a second component.

7. A system as recited in claim 6, wherein the first and the second components are a U component and a V component, respectively, in a YUV color space.

8. A system as recited in claim 7, wherein the first and the second components are each a fixed precision digital number each having a fixed number of bits.

9. A multi-resolution method of generating an output pixel chroma value, comprising:

providing a multi-resolution color space table comprising:

a low resolution table formed of a number of low resolution color space regions each mapped by a set of low resolution color space region vertices, and a high resolution look up table formed of a number of high resolution color space regions each mapped by a set of high resolution color space region vertices;

providing a tag lookup table having at least one first tag entry having a first tag entry value that identifies a unique one of the low resolution color space regions and at least one second tag entry that corresponds to the at least one first tag entry having second tag entry value such that a non zero second tag entry value identifies a unique one of the high resolution color space regions, wherein when the second tag entry value is non zero, then the high resolution color space region uniquely identified by the non zero second tag entry value is overlaid on the low resolution color space region identified by the corresponding first tag entry value;

providing a chroma offset value look up table (LUT) of chroma offset values;

using the set of high resolution color space region vertices of the overlaying high resolution color space region to lookup a set of pixel chroma offset values from the chroma offset value look up table (LUT); and generating the output pixel chroma value by adding the chroma offset value to the input pixel chroma value.

10. A method as recited in claim 9, wherein the chroma value is defined by a first and a second color space component.

11. A method as recited in claim 10, wherein the first and the second color space components are a U component and a V component, respectively, in a YUV color space.

12. A method as recited in claim 11, wherein the first and the second color space components are each a fixed precision digital number each having a fixed number of bits.

* * * * *